United States Patent [19]

Focke et al.

[11] Patent Number: 4,523,919

[45] Date of Patent: Jun. 18, 1985

[54] PROCESS AND APPARATUS FOR ATTACHING SMALL TEAR-OPEN STRIPS TO PACKAGING MATERIAL OR THE LIKE

[75] Inventors: Heinz Focke, Verden; Hans J. Bretthauer, Bremen, both of Fed. Rep. of Germany

[73] Assignee: Focke & Co., Verden, Fed. Rep. of Germany

[21] Appl. No.: 378,305

[22] Filed: May 14, 1982

[30] Foreign Application Priority Data

May 22, 1981 [DE] Fed. Rep. of Germany ..... 3120332

[51] Int. Cl.[3] ..... B31B 1/90

[52] U.S. Cl. ..... 493/212; 493/347; 493/377; 493/963; 493/930

[58] Field of Search ..... 493/86, 84, 87, 963, 493/377, 930, 212, 347, 345

[56] References Cited

U.S. PATENT DOCUMENTS

| | | | |
|---|---|---|---|
| 2,165,289 | 7/1939 | Milmoe et al. | 493/963 X |
| 2,691,856 | 10/1954 | Jensen et al. | 493/212 X |
| 2,715,861 | 8/1955 | Jacobsen | 493/212 X |
| 2,739,512 | 3/1956 | Conti | 493/377 X |
| 2,864,285 | 12/1958 | Roselius | 493/963 X |

*Primary Examiner*—James F. Coan

*Attorney, Agent, or Firm*—Sughrue, Mion, Zinn, Macpeak and Seas

[57] ABSTRACT

Small tear-open strips 10 are fed to a sheet 11 of packaging material in a timed sequence and applied to the sheet by reciprocating conveying members 22, 23 which only grip in one direction, so that the strip is pulled along in steps. As a result, a high performance and especially the transition from intermittent conveyance of the strip to continuous transport of the sheet of packaging material are possible.

8 Claims, 3 Drawing Figures

PROCESS AND APPARATUS FOR ATTACHING SMALL TEAR-OPEN STRIPS TO PACKAGING MATERIAL OR THE LIKE

BACKGROUND OF THE INVENTION

The invention relates to a process and apparatus for attaching small tear-open strips to a blank or a sheet of packaging material, the strips being severed in succession from a continuous strip and being applied to the sheet or the like.

Attaching small tear-open strips to blanks or sheets of packaging material presents a special problem in packaging technology. The relatively thin and highly flexible small strips are difficult to handle mechanically. This frequently leads to machine malfunctions when high performances of packaging machines are to be achieved, for example in packaging cigarettes.

SUMMARY OF THE INVENTION

The object on which the invention is based is to propose measures which guarantee reliable and safe handling of the small tear-open strips during the stage of feeding them and attaching them to the packaging material, while maintaining a high working speed of the machines.

To achieve this object, the process according to the invention is characterised in that the strip from which the small strips are severed is gripped in a region facing the free end, is fed and applied to the sheet of packaging material, the free end of the strip is then fixed to the sheet, and finally a portion of the strip corresponding to the length of the small strip is severed.

According to a further proposal of the invention, with the sheet being conveyed continuously, the free end of the strip is brought up to and subsequently fixed to the sheet, and then conveyed further until the small strip is severed.

The process according to the invention consequently makes it possible to feed the small strips in portions and in a timed sequence to the continuously transported sheet of packaging material. After the small strip has been applied and fixed to the sheet, the strip and the sheet are conveyed further together, the free end region of the strip being pressed continuously against the sheet and being fixed thereto, for example by glueing, welding or the like. After the small main strip has been severed, the strip web is pulled further a corresponding portion to provide the next small strip.

According to the invention, the apparatus for attaching the small strips to the sheet of packaging material is provided with a conveying member which grips the strip and is movable to and fro, and which grips the strip in a region facing its free end and conveys it up to the sheet. The conveying member is provided with gripping or clamping holders for gripping and driving the strip. These are designed so that they act only in one direction, namely during conveyance of the strip. During movement of the conveying member in the opposite direction, the gripping or clamping holders are ineffective or disengaged, so that a relative movement between the gripping or clamping holders and the strip is possible, without the latter escaping from the effective range of the gripping or clamping holders. The gripping or clamping holders preferably consist of clamping rollers with a free-wheeling in one direction of rotation. These are attached to a pivoting lever movable to and fro as a conveying member.

According to the invention, there serves for fixing the free end of the strip to the sheet a contact roller which can be lifted off so as to apply the end. As a result, the free end of the strip extending as a projecting length in front of the conveying member can be fed to the sheet by the conveying member and fixed thereto by pivoting the contact roller up against this end. When the sheet is conveyed further, the strip and finally the severed small strip are fixed to the sheet by means of the contact roller.

BRIEF DESCRIPTION OF THE DRAWINGS

Further features of the invention relate to constructive details of the apparatus. The process according to the invention and an exemplary embodiment of the apparatus are explained in more detail below with reference to the drawings in which.

DETAILED DESCRIPTION OF THE PREFERRED EMBODIMENT

Figure 1:
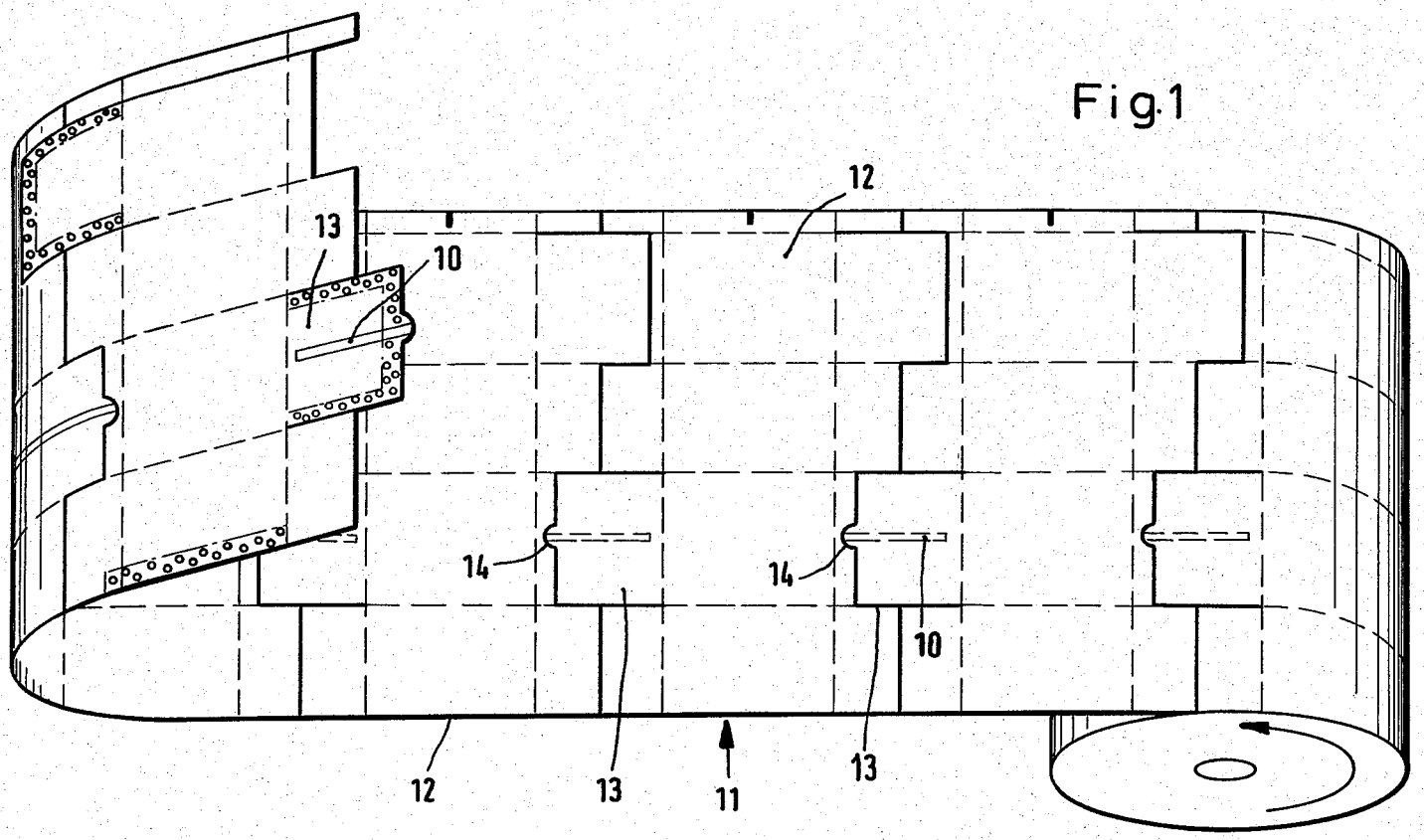
FIG. 1: shows, in a perspective representation, a sheet of packaging material for attaching small (tear-open) strips.

The preferred embodiment illustrated in the drawings relates to the attachment of relatively short, small, tear-open strips 10 to a continuous sheet 11 of packaging material, for example paper, plastic foil or the like. The small strips 10 can likewise consist of plastic or another high-tensile material. As is evident from FIG. 1, blanks 12 intended for forming cuboid packs are obtained in succession from the sheet 11 by means of transversely directed severing cuts. These packs are especially cigarette cartons, that is to say packages with a plurality of individual cigarette packs. A covering tab 13 located on the outside in the region of an end face of the pack is provided with a small strip 10 to make it easier to open the pack by tearing open or tearing off the blank 12. For this purpose, the small strip 10 is attached in a suitable place on the sheet 11, specifically on the underside or inner side of the covering tab 13 to be formed.

As is also evident from FIG. 1, the small strips 10 extend in a longitudinal and conveying direction of the sheet 11, in the centre of the covering tab 13. This is provided, at its edge formed as a result of severing, with a tongue 14 for grasping the small strip 10. In the present example, the latter extends approximately over the length of the covering tab 13.

In this practical example, the aim is therefore to feed relatively short, narrow and thin small strips 10 to the sheet 11 in a time and spatial sequence and to fasten them to the sheet 11 in a specific predetermined place. This can be carried out by glueing, thermal welding or the like.

The small strips 10 are severed from a continuous strip 15, specifically during the stage of feeding and attachment to the sheet 11. The procedure here is that the free end of the sheet 11, namely a projecting length 16, is applied and fixed to the underside of the sheet. During this time, the sheet 11 is transported continuously so that during further movement the strip 15 is conveyed correspondingly together with the sheet 11. When a sufficient length of strip 15 has been fed, the small strip 10 is severed by a transversely guided severing knife 17 in the region of the strip 15 not yet resting against the sheet 11. The rearward remaining piece of the small strip 10 is then pressed onto the sheet 11 during the further transport of this sheet. Consequently, the transfer of the strip 15 to the sheet 11 and application of the small strip 10 to the latter take place during the continuous uninterrupted conveyance of the sheet 11.

Figure 2:
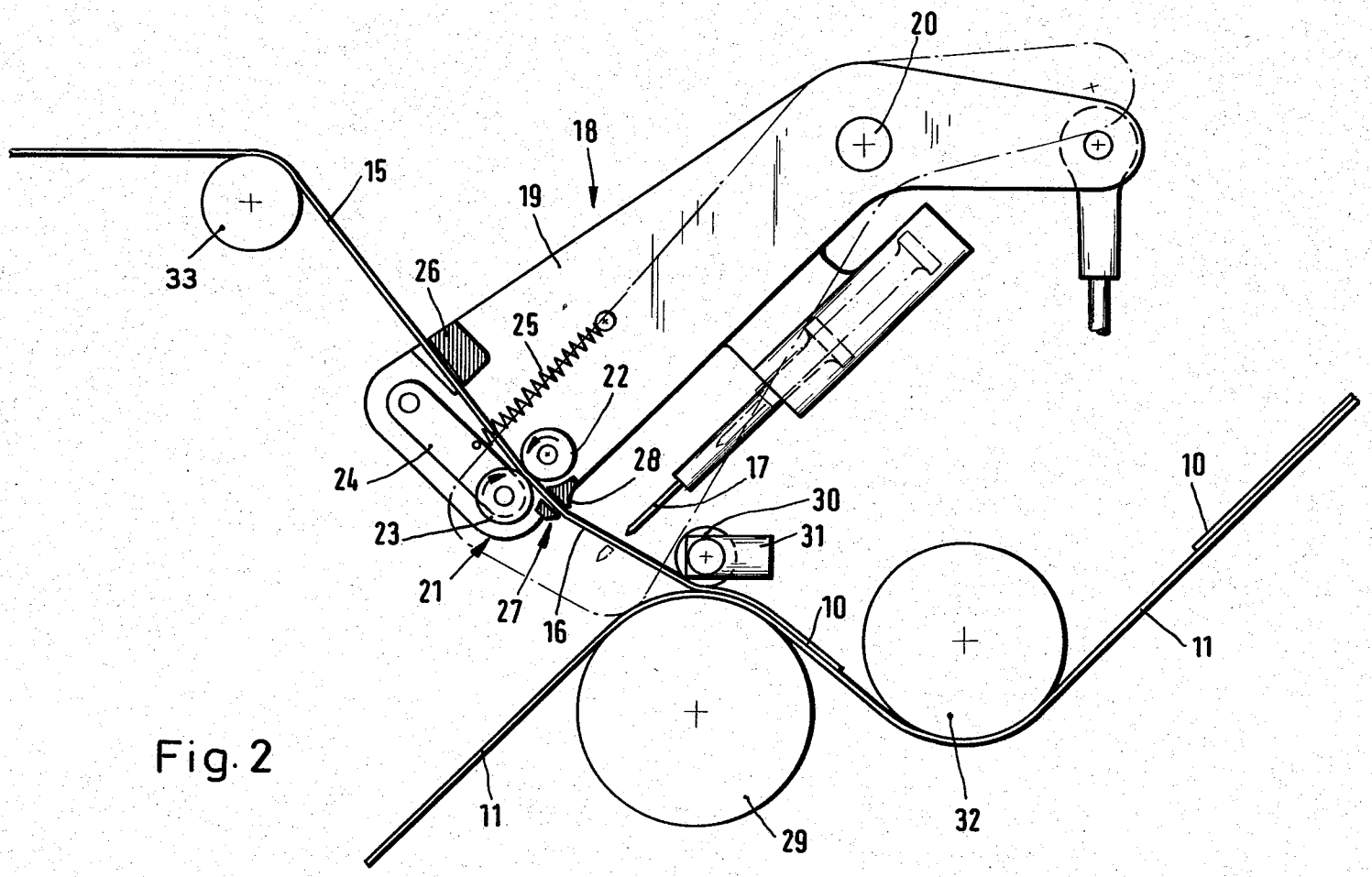
FIG. 2: shows, in a side view, an apparatus for attaching small (tear-open) strips.

The strip 15 is transported, namely pulled along, in a timed sequence by a special conveying member 18. The conveying member 18 is designed as a pivoting lever 19 (two-armed in the present case), and to its end remote from the pivot bearing 20 are attached devices for periodically gripping the strip 15. These are gripping or clamping holders 21 which are designed so that they constantly receive the strip 15 between them, but exert a retaining effect only in one direction of movement, namely when the pivoting lever 19 is moved out of the position according to FIG. 2 into that according to FIG. 3 and, at the same time, the strip 15 is pulled forward.

In the present case, the gripping or clamping holders 21 consist of two clamping rollers 22, 23 which are mounted on the lower region of the bracket-shaped pivoting lever 19 which is located at the front in the direction of advance. The strip 15 is received constantly between the clamping rollers 22, 23. The relative position is such that, when the clamping rollers 22, 23 are locked, that is to say do not rotate, the strip 15 is fixed with sufficient retaining force between them. This position is provided during the advancing movement of the conveying member 18. During movement of the conveying member 18 in the opposite direction out of the position according to FIG. 3 to that according to FIG. 2, no retaining force is exerted on the strip 15, so that it can be pulled freely through between the clamping rollers 22, 23 (as a result of its being carried along by the sheet 11).

The above-mentioned effect of the clamping and conveying action in only one direction respectively is achieved due to the fact that the two clamping rollers 22 and 23 are equipped with a free-wheel which permits rotary movements in one direction only. The contact or clamping force required is obtained by attaching the clamping roller 23 to a pivoting arm 24 which is loaded by a contact spring 25.

The strip 15 is drawn off from a relatively large supply (not shown) and is fed to the conveying member 18 via an appropriately positioned deflecting roller 33. A guide piece 26 is attached to the pivoting lever 19 and because of its position and design guarantees a specific direction of movement of the strip 15 in the region of the conveying member 18.

The severing cut through the strip 15 is executed during the return movement of the conveying member 18 to the original position (for example, FIG. 2) or when this position is reached. The severing knife 17 attached to the pivoting lever 19 in the present case is positioned such that a sufficient length of small strip 10 is produced and, at the same time, a projecting length 16 of the strip 15 extending forwards beyond the conveying member 18 is formed. This projecting length 16, because of the predetermined inherent rigidity of the small strip 10, projects beyond the conveying member 18 in a longitudinal direction and it thereby becomes possible to apply the small strip 10 freely to the sheet 11. To guarantee an exact alignment of the strip 15 or the projecting length 16 during this time, a guide mouthpiece 27, with a guide slit 28 for the strip 15, is arranged at the outermost edge of the pivoting lever 19.

The strip 15 or the small strip 10 is transferred to the sheet 11 in the region of a deflecting roller 29 of sufficient dimensions. On its peripheral face (on the top side) the strip 15 and the small strip 10 are applied and pressed on. To fix and press on the strip 15 and the small strip 10, there is in this region a contact roller 30 which can be lifted off from the sheet 11 and pressed onto this, by being arranged on a pivoting plate 31.

Figure 3:
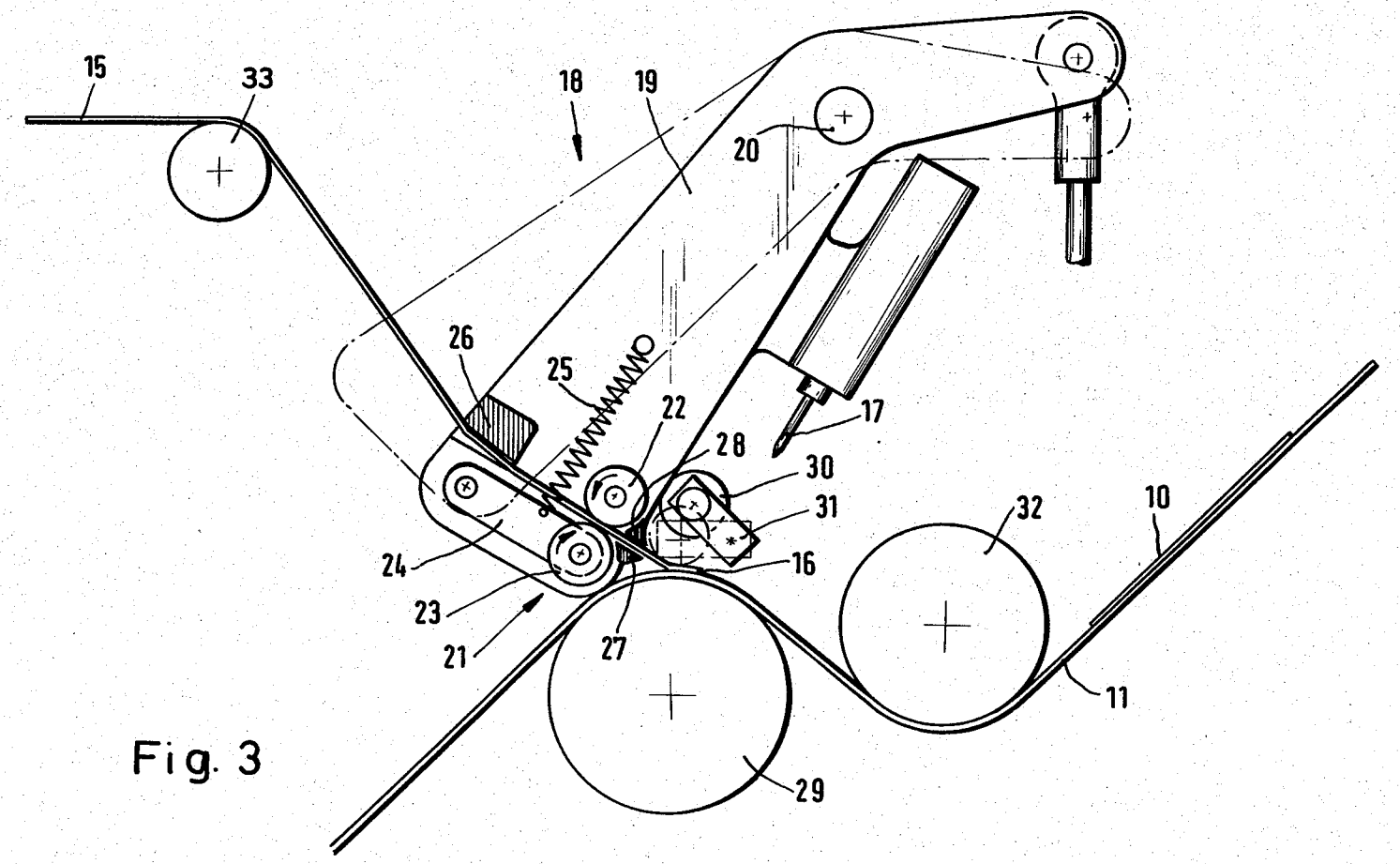
FIG. 3: shows the device according to FIG. 2, with parts of the apparatus in a different position.

At the moment when the projecting length 16 of the strip 15 is fed and applied to the sheet 11, the contact roller 30 is lifted off (the unbroken lines in FIG. 3). Immediately after this, the contact roller 30 is brought into the working position so as to fix the projecting length 16, that is to say the free end of the strip 15, to the sheet 11. At this moment, the conveying member 18 can be moved back without pulling the strip 15 back again with it. Instead, because of the retention on the sheet 11, the strip is transported further, that is to say pulled along by the latter until a sufficient severing length has been conveyed. At the same time, the small strip 10 is pressed onto the sheet 11 in the desired position.

A subsequent deflecting roller 32 for the sheet 11 causes a further permanent fixing of the small strip 10 to the sheet 11, if appropriate by the transmission of heat and pressure.

The apparatus described allows small strips 10 to be fed in a timed sequence and applied to a continuously conveyed sheet 11, with specific distances being maintained between them.

We claim:

1. A method for attaching small, elongate, tear strips (10) at predetermined positions on wrapping blanks (12) defined on a web (11) of packaging material, comprising the steps of:

(a) continuously advancing a web of packaging material through a tear strip application station, (b) gripping a continuous length of tear strip material (15) with clamping means (21) shortly behind an extending free end (16) thereof, (c) advancing the clamping means in a first direction towards the application station and attendantly advancing the free end into the application station and into engagement with the web, (d) pressing the free end against the web at the application station such that the continuous advance of the web pulls the tear strip material with it, (e) simultaneously with step (d), releasing the clamping means grip on the tear strip material and moving the clamping means in a second direction opposite to the first direction, (f) severing the tear strip material at a point spaced downstream from the clamping means to provide a new extending free end, and (g) cyclically repeating steps (b) through (f).

2. The method of claim 1, wherein the severing is performed while the clamping means is moving in the second direction.

3. The method of claim 1, wherein the severing is performed after the clamping means has completed its movement in the second direction.

4. The method of claim 1, wherein means (30) pressing the free end against the web is retracted to allow each new extending free end to be advanced into engagement with the web.

5. An apparatus for attaching small, elongate, tear strips (10) at predetermined positions on wrapping blanks (12) defined on a web of packaging material, comprising:

(a) a tear strip application station (29) for receiving a continuously advancing web (11) of packaging material, (b) a reciprocable member (19) movable back and forth between an infeed source of a continuous length of tear strip material (15) and the application station, (c) clamping means (21) mounted on the reciprocable member for releasably gripping the tear strip material shortly behind an extending free end (16) thereof, said clamping means being operably constructed to automatically grip the material when the reciprocable member moves in a first direction towards the application station and to automatically release and slide over the material when the reciprocable member moves in a second, opposite direction away from the application station, (d) means (30) at the application station for pressing an incoming free end against the web such that the continuous advance thereof pulls the tear strip material with it, and (e) means (17) for severing the tear strip material at a point spaced downstream from the clamping means, whereby the relatively delicate tear strip material is alternately advanced by the clamping means and the pressing means to minimize acceleration shocks and thereby avoid breakage and attendant shutdown.

6. Apparatus as defined in claim 5, wherein the clamping means comprises a pair of rollers 22, 23 biased together and defining a nip therebetween, said rollers each being freely rotatable in one direction and non-rotatable in another, opposite direction to implement the automatic gripping and releasing of the tear strip material.

7. Apparatus as defined in claim 6, wherein the application station is defined by a deflecting roller (29), and the pressing means comprises a contact roller engageable therewith.

8. Apparatus as defined in claim 6 or 7, wherein the severing means is mounted to the reciprocable member.

* * * * *